US007748086B2

(12) United States Patent
Bridgefarmer

(10) Patent No.: US 7,748,086 B2
(45) Date of Patent: Jul. 6, 2010

(54) POCKET MONEY BAND APPARATUS

(76) Inventor: Donnie R. Bridgefarmer, 1204 First St., McKinney, TX (US) 75069-4810

( * ) Notice: Subject to any disclaimer, the term of this patent is extended or adjusted under 35 U.S.C. 154(b) by 1143 days.

(21) Appl. No.: 11/118,294

(22) Filed: Apr. 29, 2005

(65) Prior Publication Data

US 2006/0243364 A1 Nov. 2, 2006

(51) Int. Cl.

| | |
|---|---|
| ***B65D 63/10*** | (2006.01) |
| ***A45C 11/18*** | (2006.01) |
| ***A45C 13/30*** | (2006.01) |
| *B65D 63/14* | (2006.01) |
| *A45C 1/06* | (2006.01) |

(52) U.S. Cl. ..... 24/17 B; 24/482; 150/132

(58) Field of Classification Search ..... 24/17 B, 24/17 R, 30.5 R, 30.5 P, 703.5, 31 V, 482; 150/131, 132, 120

See application file for complete search history.

(56) References Cited

U.S. PATENT DOCUMENTS

| | | | | | |
|---|---|---|---|---|---|
| RE3,260 | E | * | 1/1869 | Carrington | 24/17 R |
| 107,550 | A | * | 9/1870 | Scheydecker | 24/17 B |
| 132,230 | A | * | 10/1872 | Arms | 24/17 A |
| 212,578 | A | * | 2/1879 | Smith | 24/17 A |
| 1,960,690 | A | * | 5/1934 | Blair | 24/17 B |
| 3,279,008 | A | * | 10/1966 | Wallach | 24/16 PB |
| 3,586,085 | A | * | 6/1971 | Torongo, Jr. | 150/143 |
| 4,286,639 | A | * | 9/1981 | Murphy | 150/131 |
| 4,671,332 | A | * | 6/1987 | McPhee | 150/132 |
| 4,744,497 | A | * | 5/1988 | O'Neal | 150/134 |
| 5,279,019 | A | * | 1/1994 | Knickle | 24/17 B |
| 6,230,878 | B1 | * | 5/2001 | Lehr | 24/17 B |
| 6,357,084 | B1 | * | 3/2002 | Haidon | 24/17 B |
| 2002/0194711 | A1 | * | 12/2002 | Stampler | 24/300 |
| 2004/0103500 | A1 | * | 6/2004 | Ward | 24/17 B |

* cited by examiner

*Primary Examiner*—Robert J Sandy

(57) ABSTRACT

What is disclosed is a pocket money band apparatus made of a resilient material adapted to hold bill money and credit cards.

14 Claims, 3 Drawing Sheets

POCKET MONEY BAND APPARATUS

STATEMENT REGARDING FEDERALLY SPONSORED RESEARCH OR DEVELOPMENT

No federal grants or funds were used in the development of the present invention.

FIELD OF THE INVENTION

The present invention relates to apparatus used to hold money, credit cards and the like.

BACKGROUND OF THE INVENTION

There are several conventional means of holding money and credit cards, for example, in one's pocket, in a wallet or in a money clip. Each of these means have disadvantages. For example, loose and disorganized money and credit cards in a pocket can lead to the loss of such money and credit cards. Wallets are bulky and money clips will not hold credit cards securely. What is desired is a means of holding a nominal amount of money and credit cards, as well as other assorted items, in a non-bulky, secure, yet fashionable manner.

SUMMARY OF INVENTION

The present invention comprises a band made of a resilient material, such as leather, elastic and the like, having a first end and a second end, the band of which can be looped and then the first end coupled to the second end with a fastening or coupling means, such as a conchoe, or sewn together. Various alterations and modifications of the basic band can be made to hold a variety of small items.

The present invention will now be described with reference to the following drawings, in which like reference numbers denote the same element throughout.

DETAILED DESCRIPTION OF THE PRESENT INVENTION

The present invention comprises a band made of a resilient material, such as leather, leather-like vinyl, elastic and the like, having a first end and a second end, the band of which can be looped and then fastened with a fastening means, such as a conchoe, or sewn together. Various alterations and modifications of the basic band can be made to hold a variety of small items.

Figure 1:
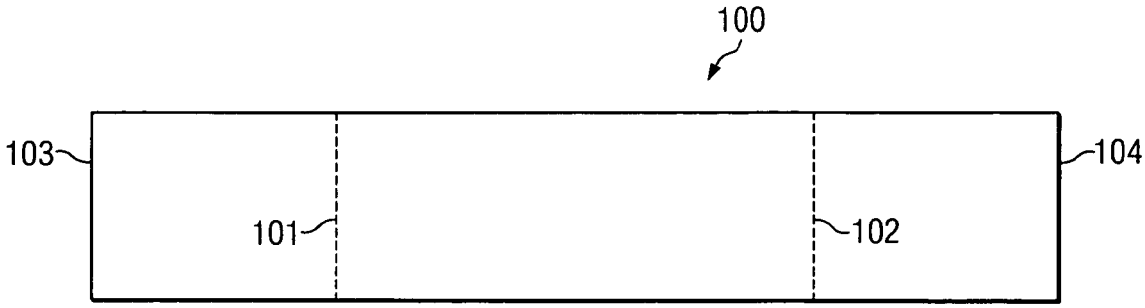
FIG. 1 is drawing of a band having a first end and a second end.
Figure 2:
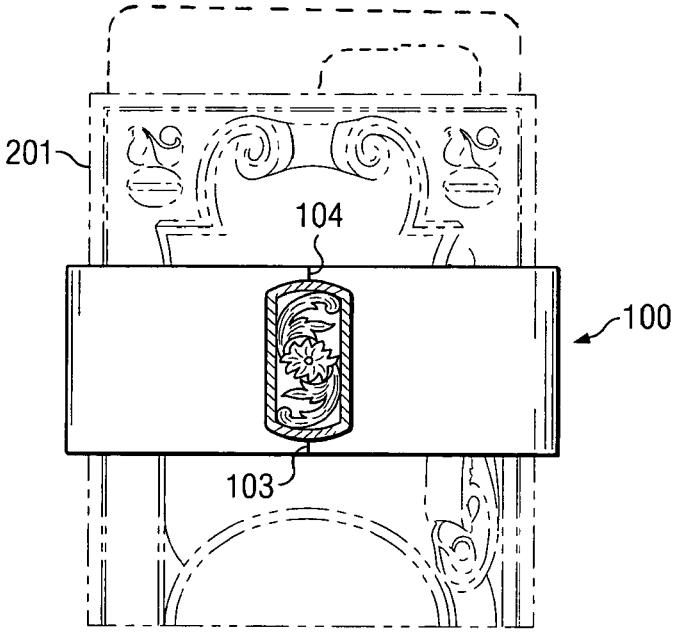
FIG. 2 is drawing of a band with the first end fastened to the second end using a conchoe.

As seen in FIG. 1, a first exemplary embodiment of the pre-formed band 100 has a height of between 1.25 to 1.5 inches and, when laid flat, a length of between 6 to 8 inches. Preferably, the band has a length that is slightly longer than 2 times the width of a conventional US bill money (2.5 inches), such that when the first end and second end of the band are formed, a bill 201 can be slid just inside the band width-wise as seen in FIG. 2. Within the folded bill, a credit card or plurality of credit cards can be placed therein. Alternatively, a user can use the pocket money band apparatus of the present invention in combination with a leather or leather-like vinyl card holder. One or more credit cards can be placed within the credit card holder and the credit card holder placed within the folded money bill that is held within the pocket money band apparatus. Pre-formed band 100 is folded along creases 101 and 102 and then coupled when the first edge 103 and the second edge 104 meet, to form the first exemplary embodiment of the first invention.

Figure 3:
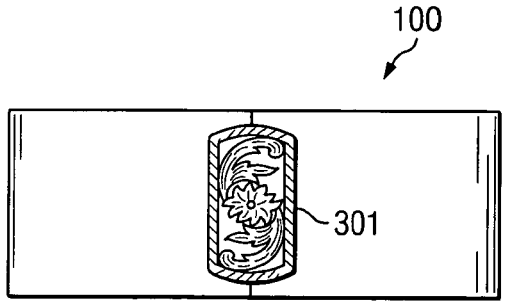
FIG. 3 illustrates the first end and the second end of the band held together by any appropriate fastening means.
Figure 4:
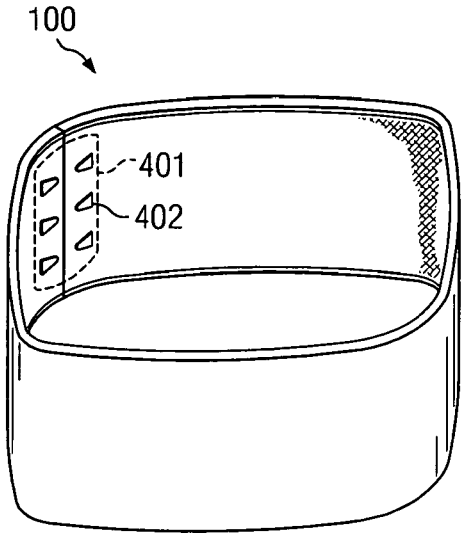
FIG. 4 illustrates a conchoe and pins fastening mechanism.

As seen in FIG. 3, the first end and the second end of the band 100 are formed and held together by any appropriate fastening means 301, including a conchoe or shell. The band 100 can be made of any resilient material such as leather, leather-like vinyl, elastic, and similar materials. The first exemplary embodiment is held together with a conchoe 401 having pins 402 that can be driven through the band and folded back as seen in FIG. 4. Precious jewels or other decorative items can be used on a form conchoe to distinguish the money band 100.

Figure 5:
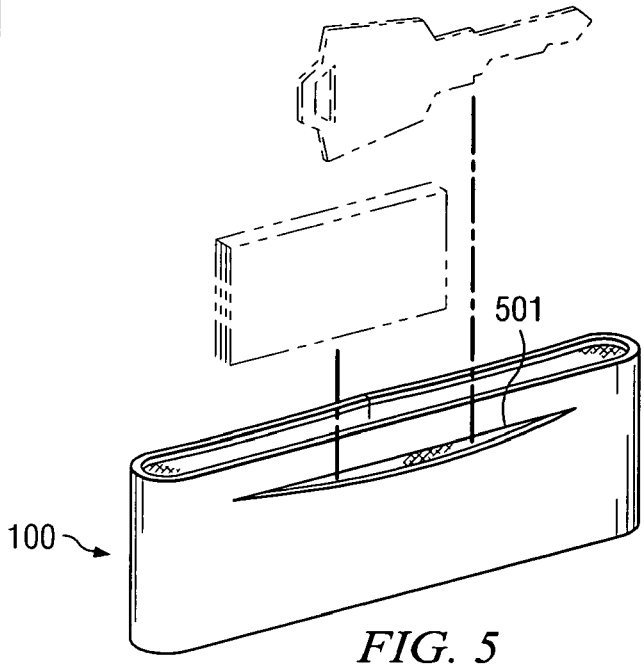
FIG. 5 illustrates a first exemplary embodiment of the present invention having a slit on one side.
Figure 6:
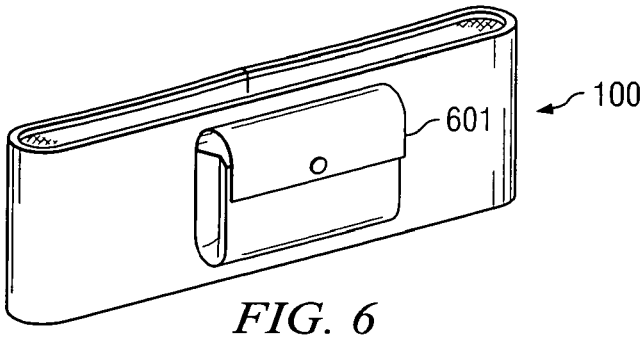
FIG. 6 illustrates a separate coin purse coupled on a side of the band.
Figure 7:
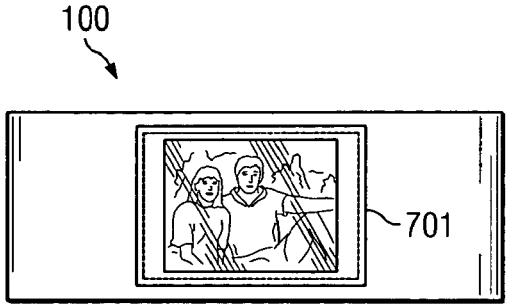
FIG. 7 illustrates a band with a pocket having a clear back to allow the holding of a picture.

As seen in FIG. 5, the first exemplary embodiment of the present invention can also have a slit 501 on one side thereof adapted to hold a small book of self-adhesive notes or to form a pocket within a first layer and second layer of band 100 to hold a small item such as a key or pocket watch. As seen in FIG. 6, a separate coin purse 601 can also be coupled on a side of band 100. Alternatively, as seen in FIG. 7, a pocket 701 having a clear back to allow the holding of a picture can be coupled to a side of the band 100 of the present invention.

The present invention further comprises the pocket money band apparatus in combination with a credit card holder to be placed within folded money located within the pocket money band apparatus.

Figure 8:
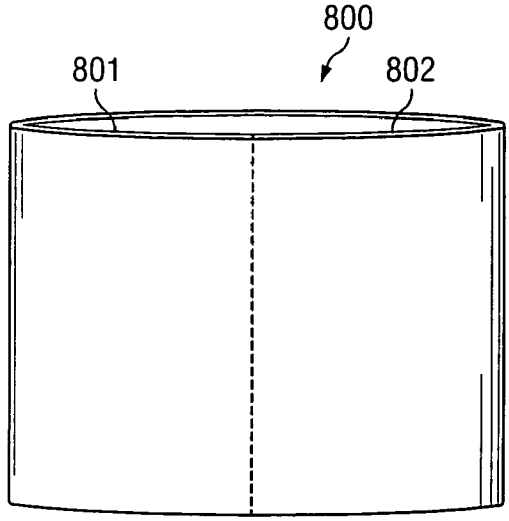
FIG. 8 illustrates a second exemplary embodiment of the present invention.
Figure 9:
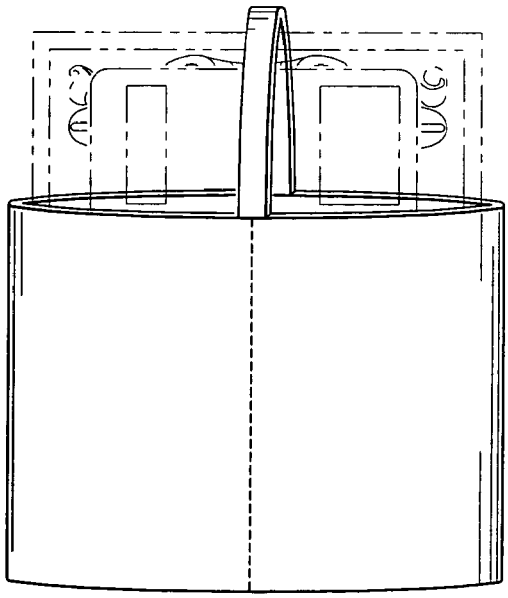
FIG. 9 illustrates an embodiment of the present invention including a strap across the top thereof adapted to hold cards and money securely within the band with a closed bottom.

As seen in FIG. 8, a second exemplary embodiment of the present invention comprises a pre-formed band 800 with a height of between 2.5 and 4 inches and, when laid flat, a length of between 6 and 8 inches. Preferably, the band 800 has a length (l) that is slightly longer than 2 times the width (w) of a conventional US bill money, such that when the first end and second end of the band 800 are formed, a bill can be slid just inside the band 800 width-wise. This apparatus can be adapted to have the bottom portions of the money band sewn together to form a closed bottom portion. Thus, it can hold credit cards and loose items without the need of a folded bill. As seen in FIG. 9, a strap coupled across the two sides of the money band is adapted to hold credit cards and money bills in place.

The pocket money band apparatus embodiments shown and described above are only exemplary. Even though several characteristics and advantages of the present invention have been set forth in the foregoing description together with details of the invention, the disclosure is illustrative only and changes may be made within the principles of the invention to the full extent indicated by the broad general meaning of the terms used in herein and in the attached claims. For example, a user can use the pocket money band apparatus of the present invention in combination with a leather or leather-like credit card holder.

What I claim is:

1. A money band apparatus, comprising:

a band made of resilient material having a height of between one of 1.25 to 1.5 inch and 2.5 to 4 inches, when laid flat, and a length of between 6 and 8 inches, such that when the first end and second end of the band are joined and coupled, a U.S. money bill can be slid just inside the band width-wise; and said band having a first crease and a second crease, the band having the first crease and the second crease prior to when the U.S. money bill is slid inside the band width-wise, the band being folded along the first crease and the second crease and then coupled along a first edge and a second edge with a coupling means.

2. The apparatus of claim 1, adapted to hold bill money and at least one credit card.

3. The apparatus of claim 1, wherein the coupling means comprises the first edge and second edge being sewn.

4. The apparatus of claim 1, wherein the resilient material is one selected from the group consisting of leather and leather-like vinyl.

5. The apparatus of claim 1, wherein the resilient material comprises a leather-like vinyl.

6. The apparatus of claim 1, wherein the resilient material comprises elastic.

7. The apparatus of claim 1, wherein the resilient material comprises a woven material.

8. The apparatus of claim 1, further comprising a conchoe being coupled to the band.

9. The apparatus of claim 1, wherein the coupling means is a conchoe.

10. The apparatus of claim 1, further comprising the band being made of leather and wherein there is a conchoe coupled to the leather band.

11. The apparatus of claim 1, further comprising the band being made of leather and wherein the coupling means is a conchoe.

12. The apparatus of claim 1, further comprising the band being made of a leather-like vinyl and wherein there is a conchoe coupled to the leather band.

13. The apparatus of claim 1, further comprising the band being made of a leather-like vinyl and wherein the coupling means is a conchoe.

14. A money band apparatus, comprising:

a band made of resilient material having a height of between one of 1.25 to 1.5 inch and 2.5 to 4 inches, when laid flat, and a length of between 6 and 8 inches, such that when the first end and second end of the band are joined and coupled, a U.S. money bill can be slid just inside the band width-wise; and said band having a first crease and a second crease, the band being folded along the first crease and the second crease and then coupled along a first edge and a second edge with a coupling means, the band having a slit on the back thereof forming a void between a first layer and second layer of the money band material.

* * * * *